US010265986B2

(12) United States Patent
Kuhne et al.

(10) Patent No.: US 10,265,986 B2
(45) Date of Patent: Apr. 23, 2019

(54) THERMAL SUBLIMATION PAPER, METHOD FOR THE PRODUCTION THEREOF AND USE THEREOF

(71) Applicant: PAPIERFABRIK AUGUST KOEHLER SE, Oberkirch (DE)

(72) Inventors: Lutz Kuhne, Ohlsbach (DE); Claus Jurisch, Offenburg Zell-Weierbach (DE)

(73) Assignee: PAPIERFABRIK AUGUST KOEHLER SE, Oberkirch (DE)

( * ) Notice: Subject to any disclaimer, the term of this patent is extended or adjusted under 35 U.S.C. 154(b) by 0 days.

(21) Appl. No.: 15/526,006

(22) PCT Filed: Nov. 11, 2015

(86) PCT No.: PCT/DE2015/100484

§ 371 (c)(1),
(2) Date: May 11, 2017

(87) PCT Pub. No.: WO2016/074671

PCT Pub. Date: May 19, 2016

(65) Prior Publication Data

US 2017/0305178 A1 Oct. 26, 2017

(30) Foreign Application Priority Data

Nov. 12, 2014 (DE) ..... 10 2014 116 550

(51) Int. Cl.

| | |
|---|---|
| ***B41M 5/52*** | (2006.01) |
| ***B41M 5/50*** | (2006.01) |
| ***B41M 5/025*** | (2006.01) |
| ***B41M 5/035*** | (2006.01) |
| ***D06P 5/28*** | (2006.01) |
| ***B41M 5/382*** | (2006.01) |
| ***D21H 25/02*** | (2006.01) |
| ***D21H 25/04*** | (2006.01) |

(52) U.S. Cl.

CPC ..... *B41M 5/502* (2013.01); *B41M 5/025* (2013.01); *B41M 5/0256* (2013.01); *B41M 5/035* (2013.01); *B41M 5/0355* (2013.01); *B41M 5/38214* (2013.01); *B41M 5/508* (2013.01); *B41M 5/52* (2013.01); *D06P 5/004* (2013.01); *D21H 25/02* (2013.01); *D21H 25/04* (2013.01); *B41M 5/5218* (2013.01); *B41M 5/5236* (2013.01); *B41M 5/5245* (2013.01); *B41M 5/5254* (2013.01); *B41M 5/5263* (2013.01); *B41M 5/5272* (2013.01)

(58) Field of Classification Search

CPC .... B41M 5/52; B41M 5/5254; B41M 5/5263; B41M 5/5272

USPC ..... 503/227

See application file for complete search history.

(56) References Cited

U.S. PATENT DOCUMENTS

| | | | | |
|---|---|---|---|---|
| 5,242,739 | A | 9/1993 | Kronzer et al. | |
| 6,017,611 | A * | 1/2000 | Cheng et al. | B32B 3/00 428/195.1 |
| 6,495,241 | B2 | 12/2002 | Sato et al. | |
| 2003/0026957 | A1 | 2/2003 | Tang et al. | |
| 2003/0107633 | A1 | 6/2003 | Sato et al. | |
| 2005/0186363 | A1 | 8/2005 | de Visser et al. | |
| 2012/0160119 | A1 | 6/2012 | Martinovic | |

FOREIGN PATENT DOCUMENTS

| | | |
|---|---|---|
| EP | 0805049 B1 | 7/2001 |

OTHER PUBLICATIONS

Search Report from WO 2016/074671.
Translation of the International Preliminary Report on Patentability from corresponding German application No. 102014116550.0.

* cited by examiner

*Primary Examiner* — Bruce H Hess
(74) *Attorney, Agent, or Firm* — Fay Sharpe LLP

(57) ABSTRACT

The invention relates to a thermal sublimation paper which can be printed with inks containing a sublimatable dye, in particular ink-jet inks, in which paper a hydrophilic thermal transfer layer to be printed is formed on a porous base paper. Thermoplastic particles with an average particle size of between 0.3 and 5 μm and a melting point of between 35° C. and 190° C. are present in the thermal transfer layer. This thermal sublimation paper can be advantageously produced as follows: an aqueous coating slip is applied to a porous base paper having a Cobb value of between 55 and 150 g/m$^2$, in particular between 70 and 150 g/m$^2$, in a paper-making or coating machine, online or offline, said aqueous coating slip containing thermoplastic particles and constituents suitable for forming a hydrophilic thermal transfer layer, and a drying step is subsequently carried out in order to obtain the thermal sublimation paper. The thermal sublimation paper can be used advantageously to print flat materials, in particular films and textiles.

23 Claims, No Drawings

THERMAL SUBLIMATION PAPER, METHOD FOR THE PRODUCTION THEREOF AND USE THEREOF

The invention relates to a thermal sublimation paper for printing with inks, especially with inkjet inks, wherein a thermal transfer layer for printing is formed on a base paper; to a method for producing it; and to the use for further printing of sheet-like materials, especially of textiles by thermal sublimation printing.

Thermal sublimation printing is an indirect printing process in which, for example, a thermal sublimation paper is printed in lateral inversion with suitable sublimable dyes, after which the printed image is transferred to the respective support material using a thermal transfer press in a transfer printing process by heating at up to 230° C. Sublimation refers to the direct transition of the dyes from the solid to the gaseous state of matter, without the otherwise customary intermediate liquid-state step. In the printing of textiles, therefore, the pattern is transferred with the sublimable dye onto the support material. This requires that the dyes, in the range from about 170 to 230° C. and at sufficient rate, sublime and diffuse, for example, into the fibres of the textile and thus adhere effectively therein. Dyes used include, especially, disperse dyes, such as preferably azo dyes and anthraquinone dyes, which are water-insoluble. Sublimation printing takes place using, especially, inkjet printers with speciality inks. After the pattern has been transferred to the material for printing, no application of colour is detected thereon, since the ink vaporizes completely into the printed material.

The advantages associated with thermal sublimation printing are to be seen especially in the possibility of printing different materials in photograph quality, the comparatively low costs, and an improved eco-friendliness. Binders and solvent, which with other printing processes may be present in the fibre and have to be washed out, are not needed. Moreover, the print is highly resistant to UV radiation and other environmental factors. The advantages of the thermal sublimation printing lie in the very good print outcome, which, moreover, is visible but barely perceptible when the goods are touched. It is possible, moreover, for all images, graphics, and photos to be realized. Even for individual pieces, thermal sublimation printing is favourable overall.

Relative to the advantages identified, the disadvantages of thermal sublimation printing as against comparison processes occupy the background. Nevertheless, the best outcomes are achieved on light-coloured textiles; with dark textiles, white carrier films would have be used as an interlayer. A certain disadvantage is that only certain textiles can be printed directly with especial advantage, and especially those textiles that are based on polymeric fibres, especially based on polyester.

On the basis of the above-described thermal sublimation technology, various advantageous onward developments have been undertaken, and are described in detail in the prior art. The prior art basis for the present invention is that according to US 2005/0186363 A1 (corresponding to CH 690 726 A5). This prior art relates to a thermal transfer paper which is suitable for printing by means of inkjet inks and which is provided, on the side to be printed, with a release layer or barrier layer. This layer is said to have a permeability or porosity of at most 100 ml/min (according to ISO standard 5636-3) and to be based preferably on polyvinyl alcohol, carboxymethyl cellulose, alginate, and gelatin. Especially preferred is carboxymethyl cellulose with a degree of substitution (DS) of about 0.2 to about 0.3. The barrier layer may incorporate fillers. This thermal sublimation paper, when coloured after inkjet printing, is said to exhibit very little, if any, running of the colours applied by printing. At the same time, during thermal transfer of the dye located on the surface of the barrier layer to a substrate, the transfer yield achieved is said to be high. This fact is attributed to the properties of the barrier layer and to its low permeability resulting in the dispersed dye particles remaining substantially on the surface of the barrier layer and penetrating not at all, or only to a greatly limited extent, into the pores of that layer. The barrier layer is said to have a composition such that the water in the aqueous dispersion of the sublimable dye particles of the inkjet ink is absorbed relatively quickly, especially by the underlying base paper or by other layers between the base paper and the barrier layer, without blocking the bores of the respective layers.

Whereas with the above-described thermal sublimation printing it is only the sublimable dye, printed onto the thermal sublimation paper, that is transferred, there is also a technology in which the pattern is first printed onto a carrier film, the carrier film being transferred completely, using a thermal transfer press, onto the material for printing. In this case the transfer film can be printed similarly to paper. It is possible accordingly to use conventional PC printers with all inks and resolution methods. It is this fundamental technical concept that forms the basis for the prior art according to US 2003/0107633 A1 and also U.S. Pat. No. 6,495,241 B2. A certain technological relatedness is shown here by the prior art according to U.S. Pat. No. 5,242,739 A. The essential difference between the thermal sublimation technique and the technology of the entire transfer of a carrier film during thermal transfer is therefore that in the former case, during thermal transfer, it is necessary to ensure a "composite strength", something which in the latter case is not so and is even ruled out. Consequently, instead, a "release layer" is provided for complete transfer of the carrier film during the printing operation.

It has emerged that the known thermal sublimation paper described above is in need of improvement, especially for the printing of textiles, the latter with regard to improved adhesion of the textiles in the transfer press, to rapid drying of the surface of the barrier layer during printing with an aqueous ink, especially an inkjet ink, and to disadvantageous smearing or running of the colours during ink application by printing (mottling).

The problem addressed by the invention is therefore that of eliminating the disadvantages of the prior art as have been outlined above. The intention especially is to optimize the adhesion of the thermal sublimation paper during the printing of, especially, sheet-like textiles, to accelerate ink drying during the printing of the thermal sublimation paper with inks, especially inkjet inks, and to very largely reduce disadvantageous mottling of the transfer print on the textile. Furthermore, during the printing operation, the transfer yield achieved is to be as high as possible.

This problem is addressed in accordance with the invention by a thermal sublimation paper for printing with inks comprising a sublimable dye, especially with inkjet inks, wherein a hydrophilic thermal transfer layer for printing is formed on a porous base paper, in that there are thermoplastic particles with a particle size of 0.3 to 5 μm and a melting point of 35° C. to 190° C. in the thermal transfer layer.

It is preferred here for the thermoplastic particles to have a melting point of 120° C. to 190° C., especially of 130° C. to 170° C. The following melting point ranges may also be considered to be preferred: 35° C. to 150° C., preferably 55° C. to 105° C., especially 75° C. to 100° C. It is useful, moreover, for the thermoplastic particles to have a particle size of 0.5 to 3 μm, especially 0.7 to 1.5 μm.

The amount of the thermoplastic particles incorporated into the thermal transfer layer is not critical. Usefully the amount is 5 to 65 wt %, especially 10 to 45 wt %. The thermoplastic particles are based on a polymer which may also be referred to as "adhesive polymer", with relatively high particle size. The inventors presume that the isolated position of the individual thermoplastic particles within the matrix of the thermal transfer layer prevents them coalescing to a film during drying in the paper machine or coating machine, and at the same time, as disruptive particles, they provide gradual hindrance to the formation of a coherent barrier layer of the water-soluble polymer. As a result, the open structure of the paper surface, which is needed for rapid drying, is retained. The selected, comparatively high, average particle size of the thermoplastic particles used proves advantageous in respect of this mechanism. This implies advantageous textile adhesion of the thermal transfer layer during color transfer in a color transfer press, in conjunction with accelerated drying of the inkjet inks during the foregoing inkjet printing of the paper.

As regards the base paper, sufficient strength and dimensional stability therein play a part with regard to its later application for the printing of various materials, especially of textiles. In order to form the base paper, therefore, the composition selected is preferably such that, during formation of the thermal transfer layer and during printing with an aqueous inkjet ink, sufficient strength and dimensional stability are ensured, so that the paper behaves dimensionally unstably, at least during printing.

In the choice of the thermoplastic material of the particles incorporated in the thermal transfer layer, the invention is not subject to any critical restriction. It is an advantage if these particles are based on polyolefins, especially on a copolymer of ethylene and propylene, polyacrylates, polymethacrylates, acrylonitrile-butadiene-styrene polymers, polylactates, polycarbonates, polyethylene terephthalate, polystyrene, polyvinyl chloride, polyether ketone, celluloid or polyamides.

Given that the thermoplastic particles are present within a more or less hydrophilic thermal transfer layer, advantages have been found to be achieved for the functional interaction between thermoplastic particles and the other physical components of the thermal transfer layer if hydrophilic groups are formed on the surface of the particles, especially in the form of carboxylate, hydroxyl, sulfonate and/or amino groups.

One especially advantageous commercial product that can be used in accordance with the invention is a polyethylene/polypropylene copolymer which is sold under the name HYPOD 2000 as a polyolefin dispersion (by Dow). The melting point is approximately 89° C., the Tg −26°, the pH of the dispersion between 9.5 and 10.5, and the specific density 0.93 g/cm$^3$.

In order to address to the desirable extent the problem posed in accordance with the invention, the thermal sublimation paper (with the base paper/thermal transfer layer basic structure) according to the invention has a porosity of at most 200 ml/min, especially at most 150 ml/min, and/or at least 25 ml/min (measured according to ISO-5636-3). With especial preference the porosity is 120 to 40 ml/min, especially 100 to 60 ml/min. The porosity figures are determined very largely by the porosity of the thermal transfer layer, and so for practical purposes its porosity values may be equated with those of the thermal sublimation paper. Deviation from this occurs when an interlayer or a reverse-side coating has a lower porosity than the thermal transfer layer and therefore becomes porosity-determining for the overall thermal sublimation paper. In such an event, air permeability values of down to 0 ml/min are conceivable.

In certain cases it is an advantage if the thermal transfer layer is applied to the wire side of the base paper, since this side has a higher smoothness than the felt side. It is normally smoother than the felt side. The thermal transfer layer achievable in this way will tend to have sufficient smoothness and coherence. For a coherent thermal transfer layer of this kind, therefore, less coating slip is necessary. Nevertheless, the application of a sufficiently thick and smooth thermal transfer layer to the felt side could have the same effect. A fundamental rule is that in a relatively dense thermal transfer layer, the transfer yield and the uniformity of the later printed image on—for example—textiles are better. Accordingly, addressed once again, an advantage of applying a thermal transfer layer to the wire side of the paper is that the wire side is smoother than the felt side. As a result of this, the thermal transfer layer formed has a more constant density and layer thickness. A uniform thermal transfer layer with constant density and layer thickness results in more uniform absorption and/or more uniform transport of the water in the ink, to the benefit of the quality of the thermal transfer print. Another advantage of forming the thermal transfer layer on the wire side is that irregularities which normally occur in paper exert less of an influence. A nonuniform thermal transfer layer results in nonuniform absorption and therefore in a reduction in the colour transfer yield and also in irregular colour transfer of the sublimable dyes from the thermal sublimation paper onto the surface—textiles especially—to be printed.

The preferred basis weight of the thermal transfer layer is between 2 and 25 g/m$^2$ oven-dry and especially between 4 and 10 g/m$^2$ oven-dry. The range from 5 to 8 g/m$^2$ oven-dry is considered especially preferable here. The basis weight of the base paper is preferably 35 to 130 g/m$^2$ oven-dry, especially 70 to 100 g/m$^2$ oven-dry. The statement of the preferred basis weight is of skilled-person importance in order for the aim set according to the invention to be achieved in an optimized way. The basis weight of the thermal transfer layer corresponds preferably to a layer thickness of 1.5 to 20 μm, especially of 3 to 8 μm. The values designated for the basis weight of the base paper correlate with a preferred layer thickness of 45 to 165 μm, especially of 90 to 130 μm.

It is useful especially to pay attention both to the Cobb value of the base paper and that of the thermal transfer layer, especially with regard to advantageous embodiments. The Cobb value provides information on the water absorbency of paper and paper materials. This value has significance for the desirable stability. Moreover, writability and printability with inks, such as with inkjet printers, is possible to a desirable extent only in the case of papers having especial water absorption values. In the present case, the Cobb value, especially, also implies a measure of the hydrophilicity of the designated layers. An assumption here is that the Cobb value of the base paper in the composite material of the invention is lower than for the original base material. It may, however, also remain the same. With preference the Cobb value of the base paper is preferably 55 to 150 g/m$^2$, especially 70 to 140 g/m$^2$. In the composite material (without reverse-side coating), preferred values are as follows: for the base paper (reverse side measured) 45 to 165 g/m$^2$, especially 55 to 150 g/m$^2$; thermal transfer layer (facing side measured) 30 to 120 g/m$^2$, especially 40 to 110 g/m$^2$. Here, accordingly, it is the water absorption which is measured. The Cobb value is determined according to DIN EN 20535. If, however, a reverse-side coating is applied, then the Cobb value, measured from the reverse side, may well be between 0 and 150 g/m$^2$, depending on the composition of the coating.

The thermal transfer layer may be adjusted especially to an advantageous degree of hydrophilicity if binders in the form of water-soluble monomers, oligomers or polymers are included, especially polyvinyl alcohol, carboxyalkylcellulose, starch, starch degradation products, especially in the form of dextrins, modified starch, cellulose derivatives, polyhydric alcohols, especially in the form of pentahydric alcohols (pentitols) and also hexahydric alcohols (hexitols), especially in the form of sorbitol, alginates and/or gelatin. Accordingly, the monomeric, oligomeric or polymeric materials employed for forming the thermal transfer layer not only are water-soluble but also endow the relevant layers (thermal transfer layer and base paper) with the desirable hydrophilicity in the context of the invention. They are therefore hydrophilic monomers, oligomers or polymers.

In certain cases it may be advantageous if the thermal transfer layer contains up to 60 wt %, especially 0.3 to 35 wt %, of a filler, especially in the form of kaolin, calcined kaolin, precipitated $CaCO_3$ and/or silica. This leads to the advantage that ink drying and the definition of the printed image are favoured.

It is at the discretion of the skilled person to incorporate further additives when producing the thermal sublimation paper of the invention, especially into the thermal transfer layer and/or into layers or interlayers formed as further options. Such additives may be, for example, organic materials, especially specific binders and/or surface-active substances, and/or inorganic materials. In certain cases the incorporation of surface-active substances is of advantage, with no restriction existing here. The surface-active substances may be anionic, cationic, amphoteric or nonionic in form.

The inkjet inks which are suitable for printing the thermal sublimation paper of the invention are aqueous inks in which the dye is present in the form of particles, especially in the form of pigments. The inkjet inks are inks comprising water as predominant liquid constituent, with the dye particles present in dispersion in the aqueous phase. Such inks may be admixed with thickeners if the ink further-processes a pasty mass, in rotary screen printing, for example. Inkjet inks typically contain dye and/or pigment particles in an order of magnitude of about 0.05 to 1 μm, especially 0.2 to 1 μm, and in practical application scenarios usefully 0.2 to 0.3 μm. In accordance with the invention, therefore, the configuration of the thermal transfer layer is such that the dye particles penetrate only insubstantially, or not at all, into the pores of the thermal transfer layer.

For the skilled person it is easy to determine sublimable dyes that are suitable for the purposes of the invention. In this regard, reference may be made to the above fundamental statements concerning thermal sublimation printing. The dyes must be able to be transferred by heating at up to 230° C. onto the selected support material. An especial requirement is that the dyes, in the range from 170° C. to 230° C. and at sufficient rate, sublime, and in the case of the printing of a textile, sublime into the fibres. Especially suitable here are those known as disperse dyes. These are generally water-insoluble dyes which are suitable especially for printing polyester fibres and acetate fibres. The molecules of dispersed dyes are the smallest molecules among all dyes. A dispersed dye molecule is based here especially on azobenzene (such as Disperse Red 1 or Disperse Red Orange, for example) or on anthraquinone, accommodating nitro, amine or hydroxyl groups and the like. Especially suitable for the purposes of the invention, accordingly, are azo dyes and anthraquinone dyes. Azo dyes are characterized by one or more azo bridges as chromophore. In terms of number, azo dyes form the greatest class of dye. They have polar or a polar substituents and can be custom-tailored accordingly to the required medium. All in all, in the light of the present invention, it is readily possible to determine and to acquire dyes suitable for the requisite sublimation process.

The thermal sublimation paper of the invention exhibits further advantageous values which are manifested especially during its application: 1. Optimum adhesion of the thermal sublimation paper during thermal transfer printing to the substrates for printing; 2. A favourable ink drying value; and 3. Advantageously reduced mottling.

An especial feature of the thermal sublimation paper of the invention is that the adhesion of the transfer layer on a substrate for printing has a rating of 3 or less, especially 1 or 2. The method by which the adhesion value is determined is described hereinafter. Furthermore, the thermal sublimation paper of the invention exhibits an advantageous ink drying value of less than 15%, especially less than 10%, with a value of 0 to 8% being especially advantageous. In the determination of the ink drying value, the procedure is that described later on. Unwanted mottling is very largely reduced in accordance with the invention. It has been found that mottling of less than 3, especially less than 2, hence including 1, is achievable. The method by which the mottling is evaluated will be shown in detail later on.

Another subject of the invention is a method for producing the thermal sublimation paper of the invention. This method is characterized in that an aqueous coating slip which contains thermoplastic particles and constituents suitable for forming a hydrophilic thermal transfer layer, as defined in the preceding claims, is applied to a porous base paper with a Cobb value of 55 to 150 g/m$^2$, especially 70 to 150 g/m$^2$, on- or offline in a paper machine or coating machine, followed by drying to give the thermal sublimation paper.

Taking account of a desirable viscosity plays a part especially in connection with carboxymethylcellulose (CMC). Given that aqueous solutions are generally of high viscosity, it is advisable to mix in with further hydrophilic substances, sorbitol and/or dextrin for example, in order to produce an especially practicable coating slip (solids content and viscosity). It is not possible fundamentally to assume that functional thermal sublimation papers can be produced only with alkoxyalkylcellulose or -starch or, more generally still, with anionic cellulose derivatives or starch derivatives. In the context of the invention, for instance, positive experiences have also been gained using natural starch and nonionic starch derivatives.

A basic guideline formulation of the invention may be represented as follows: essential constituent of the aqueous coating slip is one or more of the above-designated hydrophilic binders, and also the thermoplastic particles represented. For these two components it will be possible to specify a, based on the dry mass, for the hydrophilic binder 55 to 80% oven-dry, especially 60 to 70% oven-dry, and for the thermoplastic particles 10 to 45% oven-dry, especially 30 and 40% oven-dry. A specific guideline that could be specified here would be 66% oven-dry hydrophilic binder and 33% oven-dry thermoplastic particles. The water content of the coating slip is usefully between 60 and wt %, especially between 70 and 80 wt %; a water content of 75% might be specified as a concrete guideline. In specifying the water content and also the further constituents in the form of the hydrophilic binder and the thermoplastic particles, a guiding technical parameter designated might be the Brookfield viscosity (measured at 100 rpm). The latter is situated preferably in the range from 750 to 950 mPa·s, especially between 800 and 900 mPa·s.

In this case, with regard to the coating of the base paper, the procedure adopted especially is such that an excess of an aqueous dispersion of, especially 10 to 25 wt % of, for example, carboxymethyl cellulose is applied. It is advantageous for the excess to be stripped off subsequently with a squeegee (coating knife) and for the paper then to undergo customary drying. The customary drying may take place, especially, with steam-heated cylinders, hot air, infrared lamps, etc.

In one advantageous development of the method of the invention, between the thermal transfer layer and the base paper, in a separate operation or simultaneously on- or offline, one or more layers are formed which corresponds to the thermal transfer layer but contains no thermoplastic particles. In certain cases it is also useful if between the thermal transfer layer and the base paper, in a separate operation or simultaneously on- or offline, one or more layers are formed which do not correspond to the composition of the thermal transfer layer. It may be advantageous, furthermore, if between the thermal transfer layer and the base paper, in a separate operation or simultaneously on- or offline, a layer is formed which corresponds to the thermal transfer layer.

In general it is preferred to use an unsized base paper. In certain cases, for the success aimed at with the invention, there is no harm in employing a weakly sized base paper, something which may display advantages, such as an improved dimensional stability.

A weakly sized base paper contains preferably as sizing agent resin size, alkenylsuccinic anhydride (ASA), alkyl ketene dimer (AKD) and/or a synthetic sizing agent based on styrene-acrylate (SA).

For the formation of the thermal transfer layer, the coating slip may be applied by customary coating methods, especially in the form of a curtain coating, as roll or nozzle application with roller doctor or doctor blade, with a film press or by means of a printing process, especially with an engraved roll. It is useful, furthermore, if the desire is to achieve the effect of a certain barrier action for coating-slip or ink constituents during coating or printing, for the base paper to contain inorganic constituents, especially in the form of pigments with a pronounced platelet structure, such as kaolin or talc, for example.

Lastly, there may be advantages if, on the reverse side of the thermal sublimation paper, on- or offline, one or more further layers are formed, especially as a protective layer for preventing the unwanted sublimation of transfer dyes through the reverse side of the thermal sublimation paper. Further functions of the reverse-side coating may be to control the flatness or to prevent unwanted blocking in the roll or in the stack through an advantageous selection of the formulation of the reverse-side coating. In order to achieve this or other effects, it is advantageous if the reverse-side coating or the coating, respectively, is formed in such a way that it contains organic materials, especially binders and/or surface-active substances, and/or inorganic materials, especially pigments.

In carrying out the method of the invention, apart from the features of the invention targeted above for the thermal sublimation paper, the skilled person requires no further substantial procedural instructions. This person is able to proceed within the bounds of routine concerns.

The thermal sublimation paper of the invention, distinguished by the desirable adhesion in application or practice of the thermal sublimation printing, and also by an advantageously rapid drying on printing with inkjet inks, can be employed with advantage for printing sheet-like materials. This is preferably the case for films, irrespective of whether they are more or less hydrophilic or hydrophobic, and also for textiles, such as, especially, woven fabrics, knitted fabrics and/or felt, especially if they are constructed from manmade fibres.

Materials especially suitable for sublimation printing with the thermal sublimation paper of the invention are, for example, t-shirts and the like. They frequently comprise polymeric materials, especially polyester materials, or are coated with a polyester layer, something considered to be preferred, for example, for natural fibres, such as cotton. Suitable in principle as further fibres, accordingly, are those of polyamide, polyacrylonitrile, and cellulose acetate. Natural fibres comprising cotton and wool are less suitable. Thermal transfer printing is successful, however, if these fibres are treated beforehand, with swelling agents, for example. Likewise, support materials with a polymeric coating, such as wood, aluminium, glass or ceramic, may be printed by sublimation printing.

Prior to the use addressed, accordingly, the thermal sublimation paper of the invention is printed especially with inkjet inks in the form of an aqueous suspension. After drying has taken place, the dye particles remain on the surface of the thermal transfer layer. The coloured design formed is subsequently transferred by thermal transfer printing to the surface for printing (substrate).

Especial advantages of the invention have been expressed above. An additional advantage is that the thermal sublimation paper of the invention, on printing using an inkjet printer with an aqueous inkjet ink which contains a suspension of sublimable dyes, exhibits virtually no running of the ink. This means that there is no severe mixing of the pixels and that later a clean and satisfactory color image is formed. In the case of thermal transfer printing, moreover, advantageously, any print cloudiness (mottling) is slight at most. Finally, with the thermal sublimation paper of the invention, a desirably high transfer yield of the dyes is achieved during thermal transfer. It is significant that printing techniques suitable for the printing of the thermal sublimation paper are any such techniques which employ an aqueous ink with dye suspended therein. These techniques may also include contact printing processes, such as the screen-printing process. In any case, during sublimation printing, a sufficiently high temperature is set in the transfer press, and is generally between about 170° C. and 230° C. Even at these high temperatures, the thermal sublimation paper of the invention retains the desired composite strength. In contrast to the technology wherein a carrier film is printed on or is transferred completely to the fabric in the transfer press, and hence the composite strength is to be avoided, the thermal sublimation paper of the invention is distinguished by especial advantage in this respect. Another advantage of the invention is that the substrate for printing, preferably in sheet-like form, provided with a colour print at the thermal sublimation temperatures, is not subject to any restriction. Hence the materials involved may be not only textile materials, especially sheet-like textile materials, but also substrates made of stone, wood or metal or other comparable materials.

The invention is elucidated in more detail below by means of various examples.

EXAMPLES

A thermal transfer layer was formed on each of two different untreated papers (base paper); in a comparative example, no thermoplastic particles were incorporated, whereas in the inventive example, a modified coating was applied which additionally contains an aqueous polyolefin dispersion (water content about 55 wt %). A coat weight of 7.5 to 8 g/m$^2$ was applied in each case. The applied thermal transfer layer on the base paper was subsequently dried in a drying cabinet and thereafter conditioned for 24 h at 21° C. and 53+/−3% relative humidity. The resultant thermal sublimation paper specimens were subsequently subjected to performance evaluations. In these evaluations, the specimens were printed with the commercial inkjet ink J-next Subly (sold by J-Teck3 SRL) and also with the commercial inkjet ink Sawgrass ArTainium UV+ (sold by Sawgrass Europe), using a commercial inkjet printer (EPSON STYLUS PRO4450). The printer settings were selected here as follows: medium: photo quality inkjet paper, quality level: level 4, quality: superfine 1440×720 dpi, bidirectional: on, colour: colour/BW photo, colour matching: ICM, mode: driver ICM (standard). Transfer printing in the transfer press was performed for 40 s at 204° C.; the textile selected here was a cloth of polyester having a basis weight of 250 g/m$^2$ and a wetting angle of 56-58°/2; on an uncoated protective paper with a basis weight ≤60 g/m$^2$, the piece of textile, with the side for printing upward, and subsequently the thermal sublimation paper, with the printed thermal transfer layer downward, followed by a further uncoated protective paper with a basis weight <60 g/m$^2$, were placed. The transfer press used was a Qubeat transfer press (Model No. HP 3802 1400 W).

TABLE I (Materials data)

| | Comparative example 1 | Inventive example 1 |
|---|---|---|
| Base paper | | |
| Basis weight [g/m$^2$] | 72 | |
| Cobb value* [g/m$^2$] | 114 | |
| Air permeability* [ml/min.] acc. to Bendtsen* | 1118 | |
| Coating formula | [% oven-dry] | [% oven-dry] |
| Dextrin | 10.9 | 7.32 |
| Carboxymethylcellulose (CMC) | 33.74 | 22.66 |
| Sorbitol | 55.36 | 37.17 |
| Hypod 2000** | 0 | 32.85 |
| Water content (Total formula) | 79% | 73% |
| Drying temperature [° C.] | 105° C. | |
| Drying time [min] | 3 min | |

Notes:

*For the values marked with an asterisk in Table I and in Tables II to IV below, methods for determination and/or evaluation are identified in more detail below.

**Polyethylene-polypropylene copolymer, melting point 89° C., average particle size about 1 μm (manufacturer: Dow).

TABLE II (Measurement values for formulas in Table I)

| | Comparative example 1 | Inventive example 1 |
|---|---|---|
| Air permeability acc. to Bendtsen* [ml/min.] | 510 | 100 |
| Cobb value top side [g/m$^2$] | 72.5 | 100.4 |
| Cobb value reverse side [g/m$^2$] | 86 | 103.2 |
| Wetting angle* top side [°] | 38 | 100 |
| J-Teck test ink | | |
| Ink drying value as contrast black field [%] | 0.0 | 6.0 |
| Adhesion* [rating] | >4 | 1 |
| Mottling* [rating] | 5 | 2 |
| Optical density* measured on the textile | | |
| black | 1.18 | 1.36 |
| blue | 1.12 | 1.31 |
| yellow | 1.24 | 1.30 |
| Sawgrass test ink | | |
| Ink drying value* as contrast black field [%] | 0.0 | 2.7 |
| Adhesion* [rating] | >4 | 1-2 |
| Mottling* [rating] | 6 | 2-3 |
| Optical density* measured on the textile | | |
| black | 1.04 | 1.19 |
| blue | 1.04 | 1.25 |
| yellow | 1.21 | 1.26 |

TABLE III (Materials)

| | Comp. Ex. 2 | Inv. Ex. 2 | Comp. Ex. 3 | Inv. Ex. 3 |
|---|---|---|---|---|
| Base paper | | | | |
| Basis weight [g/m$^2$] | 94 | | 94 | |
| Cobb value [g/m$^2$] | 137 | | 137 | |
| Air permeability [ml/min.] acc. to Bendtsen | 407 | | 407 | |
| Coating formula | [% oven-dry] | [% oven-dry] | [% oven-dry] | [% oven-dry] |
| Dextrin | 10.9 | 7.32 | 10.9 | 7.32 |
| Carboxymethylcellulose (CMC) | 33.74 | 22.66 | 33.74 | 22.66 |
| Sorbitol | 55.36 | 37.17 | 55.36 | 37.17 |
| Hypod 2000** | 0 | 32.85 | 0 | 32.85 |
| Water content (Total formula) | 79% | 73% | 79% | 73% |
| Drying temperature [° C.] | 70° C. | | 105° C. | |
| Drying time [min] | 5 min | | 3 min | |

Note:

**Polyethylene-polypropylene copolymer, melting point 89° C., average particle size about 1 μm (manufacturer: Dow).

TABLE IV (Measurement values for Table III)

| | Comp. Ex. 2 | Inv. Ex. 2 | Comp. Ex. 3 | Inv. Ex. 3 | Cooler Concepts DIGITALL ™ S10 | Cham TRANSJET BOOST | Coldenhove Xtreme |
|---|---|---|---|---|---|---|---|
| Air permeability* acc. to Bendtsen [ml/min.] | 46 | 67 | 26 | 17 | 20 | 3.8 | 177 |
| Cobb value top side [g/m$^2$] | 83 | 88 | 93.2 | 92 | Sticks/not measurable | 35 | 42 |
| Cobb value reverse side [g/m$^2$] | 99 | 104 | 97.6 | 108 | 123 | 22 | 24 |
| Wetting angle* top side [°] | 24 | 80 | 30 | 110 | 44 | <20 | 28 |
| J-Teck test ink | | | | | | | |
| Ink drying value* as contrast black field [%] | 2.9 | 4.8 | 1.8 | 7.6 | 7.6 | 0.0 | 3.9 |
| Adhesion* [rating] | >4 | 1 | >4 | 1 | 3 | >4 | >4 |
| Mottling* [rating] | 6 | 1-2 | 6 | 1-2 | 2 | 1 | 1 |
| Optical density* measured on the textile | | | | | | | |
| black | 1.32 | 1.36 | 1.30 | 1.36 | 1.26 | 1.36 | 1.33 |
| blue | 1.24 | 1.34 | 1.24 | 1.33 | 1.13 | 1.33 | 1.24 |
| yellow | 1.28 | 1.31 | 1.29 | 1.31 | 1.21 | 1.35 | 1.3 |
| Sawgrass test ink | | | | | | | |
| Ink drying value* as contrast black field [%] | 2.5 | 4.0 | 3.0 | 5.4 | 17.7 | 0.0 | 6.6 |
| Adhesion* [rating] | >4 | 1 | >4 | 1 | 2 | 4 | >4 |
| Mottling* [rating] | 6 | 2 | 6 | 2 | 1 | 1 | 1-2 |
| Optical density* measured on the textile | | | | | | | |
| black | 1.17 | 1.19 | 1.18 | 1.23 | 1.22 | 1.23 | 1.24 |
| blue | 1.20 | 1.24 | 1.22 | 1.28 | 1.25 | 1.25 | 1.27 |
| yellow | 1.21 | 1.27 | 1.23 | 1.27 | 1.19 | 1.22 | 1.21 |

Measurement and Evaluation Methods whose Results are Identified in Tables I to IV:

1. The Cobb value is determined according to ISO-535, the Bendtsen air permeability (or porosity) according to ISO-5636-3, and the basis weight according to ISO-536.

2. Ink Drying Value

The drying rate of the ink on the thermal sublimation paper is reported as a contrast value in percent in the black field. For this purpose, immediately after the end of printing, the printed thermal sublimation sheet was placed with the unprinted side downward onto a cardboard support; 15 s after the end of printing, a counter-strip (Phoenix Imperial II/II, APCO lightfast glossy white, wood-free 150 g/m$^2$, from Scheufelen) was placed onto the printed area and was immediately rolled down using a metal roller weighing 2.3 kg, without pressure. The counter-strip was then removed and, on the side facing the original inkjet print, the contrast value was determined by measuring the reflection with a commercial measuring instrument (Elrepho SE 070 instrument from Lorentzen & Wettre) at a position (a) of the counter-strip, originally facing the black field, and also at a position (b) of the centre-strip facing an originally unprinted area, as follows:

$$\text{Contrast [\%]} = \frac{(R2 - R1) * 100}{R2}$$

(R2=reflection (Y 395 nm) of position b, R1=reflection of position a)

3. Mottling

Determination of the mottling, as the degree of cloudiness of the transferred print on the textile, was accomplished visually and was evaluated according to the following scale of ratings:

Rating 1: very good, print absolutely cloud-free
Rating 2: good, print cloud-free
Rating 3: satisfactory, print slightly unsettled
Rating 4: adequate, print unsettled
Rating 5: deficient, print cloudy
Rating 6: inadequate, print very cloudy 4. Wetting Angle The wetting angle was determined using a commercial wetting angle measuring instrument from Lorentzen & Wettre. The droplet size (height and width) was measured 10 s after placement of the water droplet (demineralized water) with the syringe tip. In each case three measurements were carried out on a test strip 15 mm wide, and the average value without decimal places was reported.

5. Adhesion

The adhesion of the thermal sublimation paper to the textile was determined as follows. After implementation of transfer printing in the transfer press, the adhesion of the thermal sublimation paper to the textile was characterized on manual separation of these layers, in ratings as characterized below, on a laboratory bench. Separation in this case was performed by parting one corner of the sheet-like textile from the paper layer and then peeling off the textile manually at an angle of 90° to 120° from the flat-lying paper.

Rating 1: specimen sticks significantly to the textile
Rating 2: specimen sticks slightly to the textile
Rating 3: specimen sticks very slightly to the textile
Rating 4: specimen does not stick to the textile Rating 5: detachment of the specimen from the textile is possible only with damage to the specimen Rating 6: detachment of the specimen from the textile is possible only with destruction of the specimen 6. The Optical Density was Measured with a GretagMacbeth D19C in Automatic Colour Mode.

The invention claimed is:

1. A thermal sublimation paper for printing with inks containing a sublimable dye, wherein a hydrophilic thermal transfer layer for printing is formed on a substrate consisting essentially of a porous base paper, characterized in that in the thermal transfer layer there are thermoplastic particles with a particle size of 0.3 to 5 μm and a melting point of 35° C. to 190° C. and also hydrophilic monomers, oligomers or polymers, wherein the thermal transfer layer contains 5 to 65 wt % of thermoplastic particles, and wherein the thermoplastic particles have hydrophilic groups on their surface in the form of carboxylate, hydroxyl, sulfonate and/or amino groups.

2. A thermal sublimation paper for printing with inks containing a sublimable dye, wherein a hydrophilic thermal transfer layer for printing is formed directly on a porous base paper, characterized in that in the thermal transfer layer there are thermoplastic particles with a particle size of 0.3 to 5 μm and a melting point of 35° C. to 190° C. and also hydrophilic monomers, oligomers or polymers, wherein the thermal transfer layer contains 5 to 65 wt % of thermoplastic particles.

3. A thermal sublimation paper according to claim 2, characterized in that the thermoplastic particles have a melting point of 120° C. to 190° C.

4. A thermal sublimation paper according to claim 2, characterized in that the thermal transfer layer contains 10 to 45 wt %, of thermoplastic particles.

5. A thermal sublimation paper according to claim 2, characterized in that the thermoplastic particles are based on polyolefins, a copolymer of ethylene and propylene, polyacrylates, polymethacrylates, acrylonitrile-butadiene-styrene polymers, polylactates, polycarbonates, polyethylene terephthalate, polystyrene, polyvinyl chloride, polyether ketone, celluloid or polyamides.

6. A thermal sublimation paper according to claim 2, characterized in that the Cobb value of the base paper measured on the reverse side of the composite material is 45 to 165 g/m$^2$ and the Cobb value of the thermal transfer layer measured in the composite material on the top side is 30 to 120 g/m$^2$.

7. A thermal sublimation paper according to claim 2, characterized in that the base paper has a wire side and a felt side, and the thermal transfer layer is on the wire side of the base paper.

8. A thermal sublimation paper according to claim 2, characterized in that the thermal sublimation paper has a porosity of at most 200 ml/min, and/or at least 25 ml/min (measured according to ISO-5636-3).

9. A thermal sublimation paper according to claim 2, characterized in that the thermal transfer layer is made hydrophilic by incorporation of water-soluble monomers, oligomers or polymers, selected from polyvinyl alcohol, carboxyalkylcellulose, starch, starch degradation products, dextrins, modified starch, cellulose derivatives, polyhydric alcohols, pentahydric alcohols (pentitols) and also hexahydric alcohols (hexitols), sorbitol, alginates and/or gelatin.

10. A thermal sublimation paper according to claim 2, characterized in that the thermal transfer layer contains 0.3 to 60 wt % of a filler selected from kaolin, calcined kaolin, precipitated $CaCO_3$ and/or silica.

11. A thermal sublimation paper according to claim 2, characterized in that it contains surface-active substances in amphoteric, cationic, anionic or nonionic form.

12. A thermal sublimation paper according to claim 2, characterized in that the layer thickness of the thermal transfer layer is 1.5 to 20 μm.

13. A thermal sublimation paper according to claim 2, characterized in that the layer thickness of the base paper is 45 to 165 μm.

14. A thermal sublimation paper according to claim 2, characterized in that the base paper contains inorganic constituents in the form of $CaCO_3$, kaolin or talc.

15. A method for producing a thermal sublimation paper according to claim 2, characterized in that an aqueous coating slip which contains thermoplastic particles and hydrophilic monomers, oligomers or polymers for forming a hydrophilic thermal transfer layer is applied to a porous base paper with a Cobb value of 55 to 150 g/m$^2$, on- or offline in a paper machine or coating machine, followed by drying to give the thermal sublimation paper.

16. A method according to claim 15, characterized in that between the thermal transfer layer and the base paper, in a separate operation or simultaneously on- or offline, one or more layers are formed which correspond to the thermal transfer layer but contain no thermoplastic particles.

17. A method according to claim 15, characterized in that between the thermal transfer layer and the base paper, in a separate operation or simultaneously on- or offline, one or more layers are formed which do not correspond to the composition of the thermal transfer layer.

18. A method according to claim 15, characterized in that between the thermal transfer layer and the base paper, in a separate operation or simultaneously on- or offline, an interlayer is formed which corresponds to the thermal transfer layer.

19. A method according to claim 15, characterized in that an unsized base paper is used.

20. A method according to claim 15, characterized in that the coating slip for forming the thermal transfer layer is applied in the form of a curtain coating, as roll or nozzle application with roller doctor or doctor knife, with a film press, by means of a printing process, or with an engraved roll.

21. A method according to claim 15, characterized in that on the reverse side of the thermal sublimation paper, on- or offline, one or more further layers are formed as protective layer.

22. A method according to claim 21, characterized in that a reverse side coating is formed which contains binders and/or surface-active substances, and/or pigments.

23. A thermal sublimation paper for printing with inks containing a sublimable dye, wherein a hydrophilic thermal transfer layer for printing is formed on a porous base paper, characterized in that in the thermal transfer layer there are thermoplastic particles with a particle size of 0.3 to 5 μm and a melting point of 35° C. to 190° C. and also hydrophilic monomers, oligomers or polymers, wherein the thermal transfer layer contains 5 to 65 wt % of thermoplastic particles, and wherein the thermoplastic particles have hydrophilic groups on their surface, in the form of carboxylate, hydroxyl, sulfonate and/or amino groups.

* * * * *